US008555553B2

(12) United States Patent
Block et al.

(10) Patent No.: US 8,555,553 B2
(45) Date of Patent: Oct. 15, 2013

(54) COLLAPSIBLE DOOR APPARATUS

(76) Inventors: Mike Block, Phoenix, AZ (US); Kip Cunningham, Phoenix, AZ (US); Lowell Kramer, Phoenix, AZ (US)

( * ) Notice: Subject to any disclaimer, the term of this patent is extended or adjusted under 35 U.S.C. 154(b) by 99 days.

(21) Appl. No.: 13/050,873

(22) Filed: Mar. 17, 2011

(65) Prior Publication Data

US 2011/0225886 A1 Sep. 22, 2011

Related U.S. Application Data

(60) Provisional application No. 61/314,777, filed on Mar. 17, 210.

(51) Int. Cl.
*E06B 5/20* (2006.01)

(52) U.S. Cl.
USPC ..... 49/501; 49/31; 49/70; 340/666

(58) Field of Classification Search
USPC ..... 49/31, 70, 501, 141, 163, 164, 165, 49/168, 169, 170, 172, 173, 188, 189, 190, 49/191; 73/768, 774; 340/666, 665, 540, 340/545.2, 573.1
See application file for complete search history.

(56) References Cited

U.S. PATENT DOCUMENTS

| | | | | |
|---|---|---|---|---|
| 1,273,520 | A * | 7/1918 | Millsaps | 49/168 |
| 4,643,318 | A * | 2/1987 | Kopp | 211/123 |
| 4,675,659 | A * | 6/1987 | Jenkins et al. | 340/573.1 |
| 7,024,823 | B2 * | 4/2006 | Keller | 49/399 |
| 7,466,237 | B1 * | 12/2008 | Cook | 340/665 |
| 7,999,690 | B1 * | 8/2011 | Shilts | 340/666 |
| 2009/0293364 | A1 * | 12/2009 | Garstad et al. | 49/70 |
| 2010/0101149 | A1 * | 4/2010 | Keller | 49/399 |
| 2011/0068927 | A1 * | 3/2011 | Berger | 340/573.1 |

* cited by examiner

*Primary Examiner* — Jerry Redman

(57) ABSTRACT

A suicide prevention door kit has a movable upper segment having a top surface and a mechanism. The movable upper segment is supported by the mechanism. The mechanism is configured to transition between a loaded state and a triggered state. The top surface is approximately horizontal in the loaded state and sloped in the triggered state. The suicide prevention door kit further comprises a switch in communication with the mechanism. The switch is configured to cause the mechanism to transition from the loaded state to the triggered state.

19 Claims, 8 Drawing Sheets

COLLAPSIBLE DOOR APPARATUS

RELATED APPLICATIONS

This Application claims priority to prior U.S. Provisional Application having Ser. No. 61/314,777 filed Mar. 17, 2010 and titled "Collapsible Door Apparatus and Method Thereof," of which is incorporated by reference herein.

FIELD

Various implementations of the present invention, and combinations thereof, are related to wall mounted kits adapted to reduce or eliminate the occurrence of suicides in certain scenarios. More particularly, the invention relates to a wall mounted kit in which the upper portion of the kit is configured to collapse under an applied force to form a sloped surface. Most particularly, the invention relates to a collapsible door configured to function as a traditional door, yet collapse under an applied load to form a sloped surface that allows the applied load to slide down and fall off the door.

BACKGROUND

Some facilities house patients at risk of committing suicide. These facilities include medical facilities, mental institutions, prisons, and detention centers. One common method of suicide is by hanging. In this method, an individual can utilize a physical support of sufficient height, such as the top surface of a door, to provide physical support. Doors, however, are necessary to provide privacy, solitude, isolation, and containment in such facilities. It is therefore desirable to provide a system to reduce or eliminate the occurrence of suicides in cases where a door is used as the physical support by an individual to hang himself, while at the same time maintaining the benefits provided by the door.

SUMMARY

The present system can be used in conjunction with or as a substitute for a typical door used in, for example, rooms, offices, bathroom stalls, or entryways. In one implementation of the present system, a collapsible door comprises a body formed to include a cavity and a blade attached to the body. The blade is configured to retract into the cavity. The collapsible door further comprises a mechanism disposed within the cavity. The mechanism is configured to transition the door between a loaded state and a triggered state. A top surface of the collapsible door is approximately horizontal in the loaded state and the top surface of the collapsible door is sloped in the triggered state to form an angle between about 6 degrees and about 45 degrees from the horizontal. The collapsible door further comprises a pressure sensor in contact with the blade, wherein the pressure sensor is configured to cause the mechanism to transition from the loaded state to the triggered state.

In one implementation, a collapsible door kit comprises a body formed to include a cavity and a mechanism disposed within the cavity. The mechanism is configured to transition between a loaded state and a triggered state. The top surface of the collapsible door kit is approximately horizontal in the loaded state and the top surface of the collapsible door kit is sloped in the triggered state. The collapsible door kit further comprises a blade disposed at least partially above the mechanism. The blade is supported by the mechanism. The collapsible door kit further comprises a pressure sensor in contact with the blade. The pressure sensor is configured to cause the mechanism to transition from the loaded state to the triggered state.

In one implementation, a collapsible structure comprises a movable upper segment having a top surface and a mechanism. The movable upper segment is supported by the mechanism. The mechanism is configured to transition between a loaded state and a triggered state. The top surface is between about 1 inch and about 3 inches wide and between about 20 inches and about 45 inches long. The top surface is approximately horizontal in the loaded state. The top surface is sloped in the triggered state. The collapsible structure further includes a switch in communication with the mechanism. The switch is configured to cause the mechanism to transition from the loaded state to the triggered state.

BRIEF DESCRIPTION OF THE DRAWINGS

Implementations will become more apparent from the detailed description set forth below when taken in conjunction with the drawings, in which like elements bear like reference numerals.

DETAILED DESCRIPTION

The present system is described in various implementations in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the present system may be combined in any suitable manner in one or more implementations. In the following description, numerous specific details are recited to provide a thorough understanding of the various implementation. The present system may be practiced without one or more of the specific details described, or with other methods, components, materials, and so forth. In other instances, well-known structures, materials, or operations are not shown or described in detail to avoid obscuring aspects of the invention.

Figures 1A, 1B, 1C:
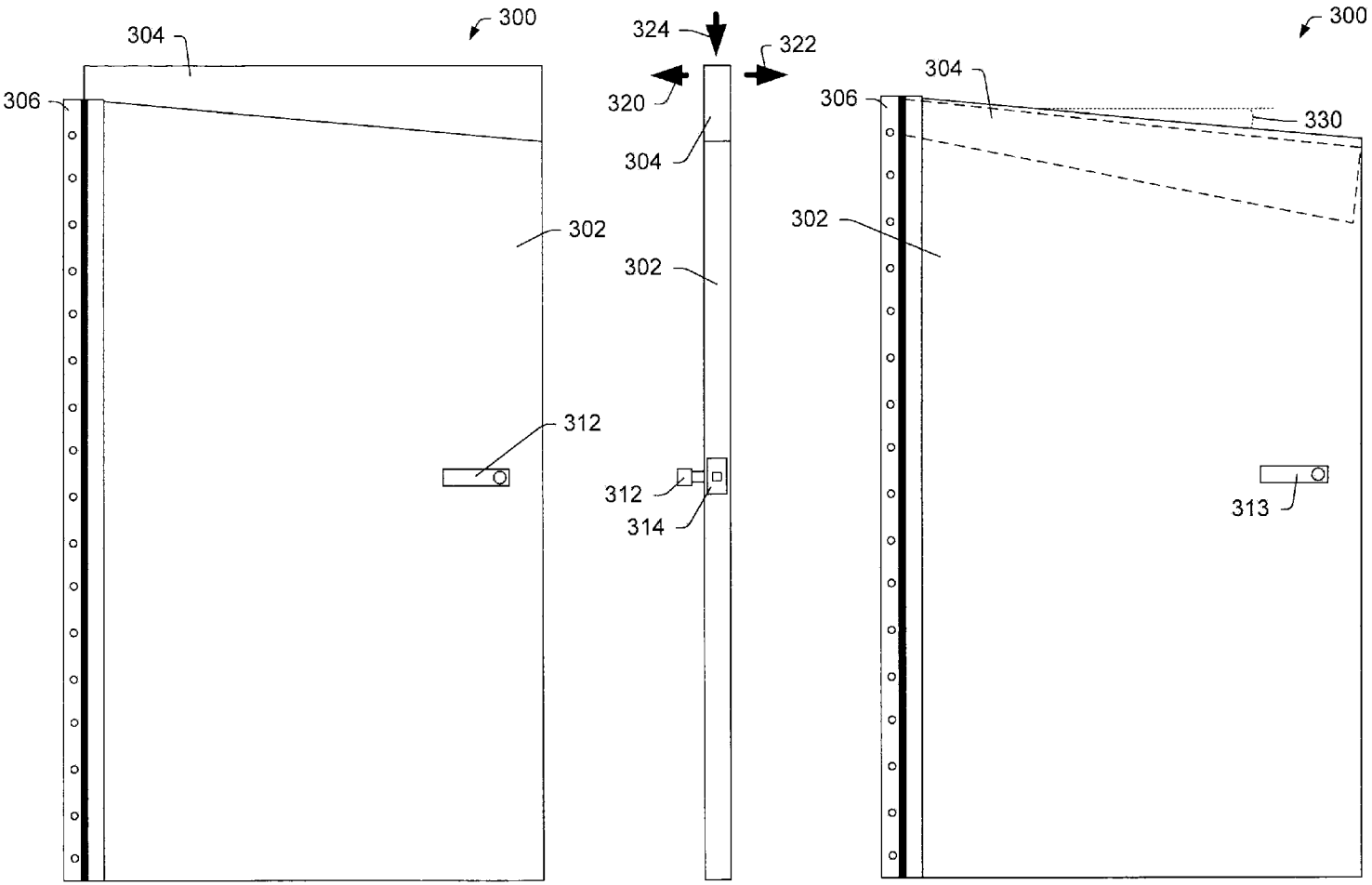
FIGS. 1(*a*)-1(*c*) are illustrations depicting the operation of an exemplary collapsible door.

FIGS. 1(*a*)-1(*c*) are illustrations depicting the operation of an exemplary collapsible door. Referring to FIG. 1(*a*), a collapsible door 300 has a body 302. The body 302 may be constructed from any material suitable for use in a door, including steel, aluminum, wood, or reinforced polyester. In one implementation, a full mortise continuous hinge 306 is attached to the body 302. The hinge 306 is used to mount the collapsible door 310 to a door frame. In another implementation, two of more hinges, of any type suitable for mounting, may be used to mount the collapsible door 310 to a door frame. A handle 312 is mounted to the body 302.

The top portion of the collapsible door 300 includes a collapsible section 304. The collapsible section 304 may be composed of the same or different material as the body 302. The collapsible section 304 is mounted on the body 302 by a mechanism (not shown). In one implementation, the mechanism is housed in a cavity within the body 302. In one implementation, the mechanism is housed in a cavity within the collapsible section 304.

The collapsible section 304 is configured to fall into the body 302 when the mechanism is triggered. In one implementation, the collapsible section 304 falls to the side of or around the body 302. In some cases, the mechanism is triggered when sufficient force is applied to the collapsible section 304. The force triggers a mechanism that allows the collapsible section 304 to drop. In some implementations, the force is detected by an electrical sensor or mechanism allowing the collapsible section 304 to drop.

In one implementation, the top surface of the body 302 is sloped. In another implementation, the top surface of the body 302 is horizontal. In different implementations, when the collapsible section 304 has dropped, a sloped surface is formed by the collapsible section 304, a sloped surface is formed by the body 304, or a sloped surface is formed by a combination of the body 302 and the collapsible section 304.

Referring to FIG. 1(*b*), a side view of the collapsible door 300 of FIG. 1(*a*) is depicted. The body 302, collapsible portion 304, handle 312, and door latch mechanism 314 can be seen in this view. In one implementation, the collapsible portion 304 is triggered to drop by a downward force 324. In one implementation, the collapsible portion 304 is triggered to drop by a lateral force 320. In one implementation, the collapsible portion 304 is triggered to drop by a lateral force 322. In one implementation, the collapsible portion 304 is triggered to drop by a combination of a downward force 324 and a lateral force 320 or 322.

Referring to FIG. 1(*c*), the collapsible door 300 is shown after sufficient force has been applied to the collapsible section 304, triggering the mechanism to cause the collapsible section 304 to drop into the body 302. In one embodiment, the collapsible portion 304 retracts fully into the body 302, exposing the sloped surface formed by the body 302 after being triggered. The body 302 forms a top surface with an angle 330 measured from the horizontal. The angle varies on the width of the door and the particular application. In one implementation, the angle 330 is about 30° from the horizontal. In different embodiments, the angle 330 may be between about 6° and about 45° from the horizontal.

In another embodiment, the collapsible portion 304 may retract partially within the body 302. The exposed top surface of the collapsible portion 304 forms a sloped surface after the mechanism is triggered.

The force necessary to trigger the mechanism will be a force less than that to support the weight of an individual, but will be determined by the particular application. For example, the collapsible door installed in a juvenile detention center may be configured to respond to a lower force than a collapsible door installed at an adult detention facility. In one implementation, the downward force 324 to trigger the mechanism is about 5 lbs. In one implementation, the lateral force 320 or 322 to trigger the mechanism is about 5 lbs. In one implementation, the mechanism is triggered by deflecting the top of the collapsible portion 304 5° from the vertical relative to the body 302 of the collapsible door 300.

Figure 2:
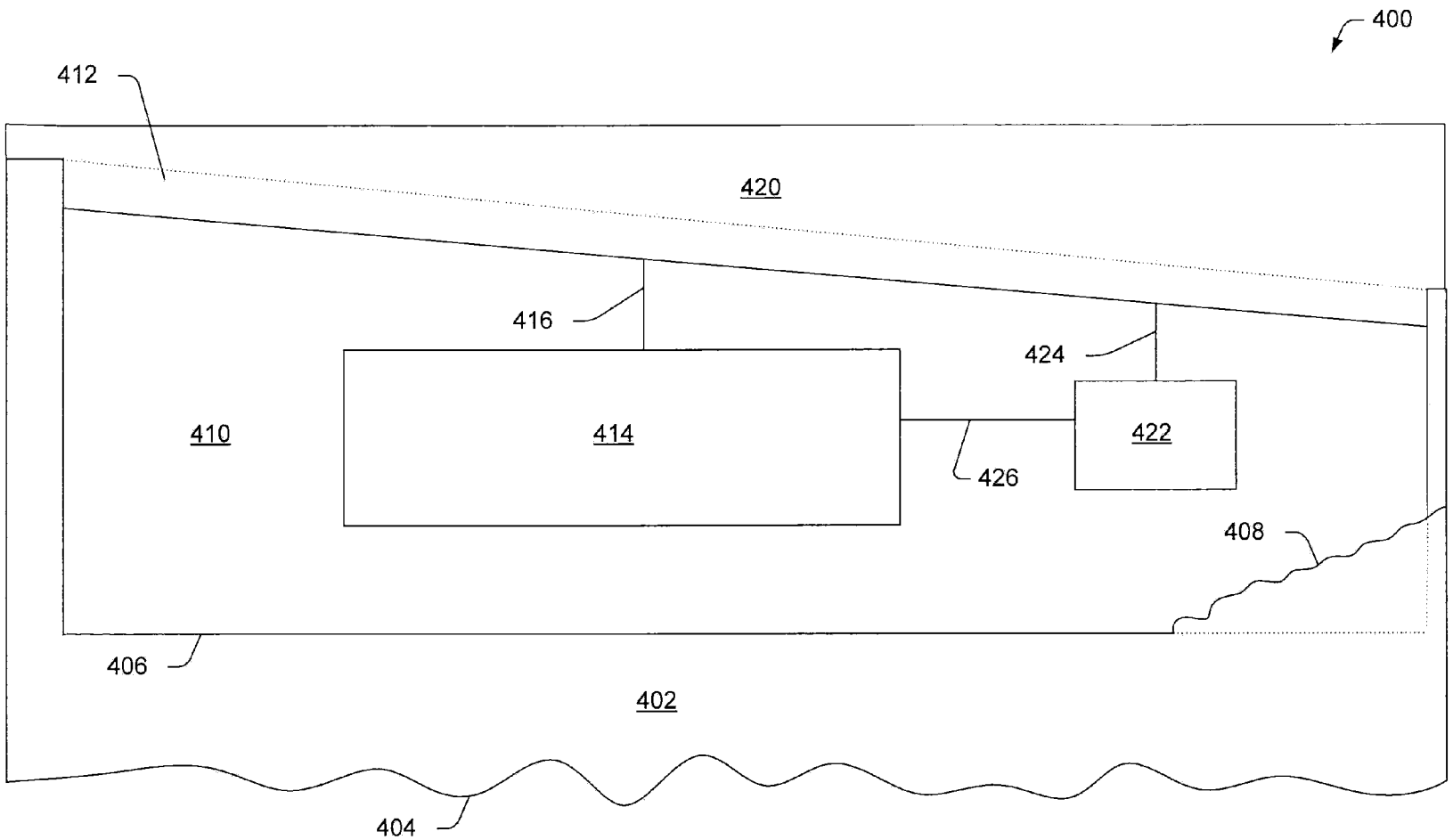
FIG. 2 is a block diagram depicting the components of a exemplary collapsible door that is triggered by a downward force.

Referring to FIG. 2, an illustration depicting the functional blocks of one implementation of a collapsible door is depicted. The collapsible door system 400 comprises a door body 402. A break line 404 indicates that the lower portion of the door body 402 has been omitted from the drawing. The door body 402 contains an internal cavity 406. A portion of the door body 402 extends over the internal cavity 406. A break line 408 indicates that a portion of the door body 402 has been omitted from the drawing to expose the internal cavity 406. The door body 402 also comprises a backplane 410 that extends behind the internal cavity 406. The top of the door body 402 is represented by broken line 412.

A drop mechanism 414 is mounted to backplane 410. The drop mechanism 414 holds the drop segment 420 in the raised position by a support means 416. The top of the drop segment 420 forms a horizontal surface when in the loaded state.

A pressure sensor 422 is in communication with drop segment 420 by a link 424. The pressure sensor 422 is in communication with drop mechanism 414 by a link 426. In one implementation, the pressure sensor is integrated into the support means 416.

When the pressure sensor 422 detects, via the link 424, a sufficient amount of pressure, the pressure sensor 422 activates the drop mechanism 414 through the link 426. In one implementation, the pressure sensor 422 detects pressure that is exerted downward on the top of drop segment 420. In one implementation, the pressure sensor 422 detects pressure that is exerted laterally on the top of drop segment 420. In one implementation, the pressure sensor 422 detects pressure that is exerted both downward and laterally on the top of drop segment 420.

Once activated, the drop mechanism 414 releases the support means 416, thereby allowing the drop segment 420 to fall downward into the internal cavity 406. Once the drop segment 420 comes to rest, the top of the drop segment 420 forms an angled (i.e., sloped) surface.

In another implementation, the pressure sensor 422 comprises an electromechanical pressure sensing device positioned along the top edge of drop segment 420. Any pressure exerted downward on the top of the drop segment 420 is detected by the electromechanical pressure sensing device. Upon application of sufficient force, the electromechanical pressure sensing device sends a signal to drop mechanism 414. The force necessary to trigger the mechanism will be a force less than that to support the weight of an individual, but will be determined by the particular application. For example, the collapsible door installed in a juvenile detention center may be configured to respond to a lower force than a collapsible door installed at an adult detention facility.

In yet another implementation, the pressure sensor 422 may be a positional sensor that detects the position of the drop segment 420. When pressure exerted downward on the top of the drop segment 420 causes the drop segment 420 to move downward or laterally a sufficient amount, the positional sensor sends a signal to trigger drop mechanism 414.

Figure 3:
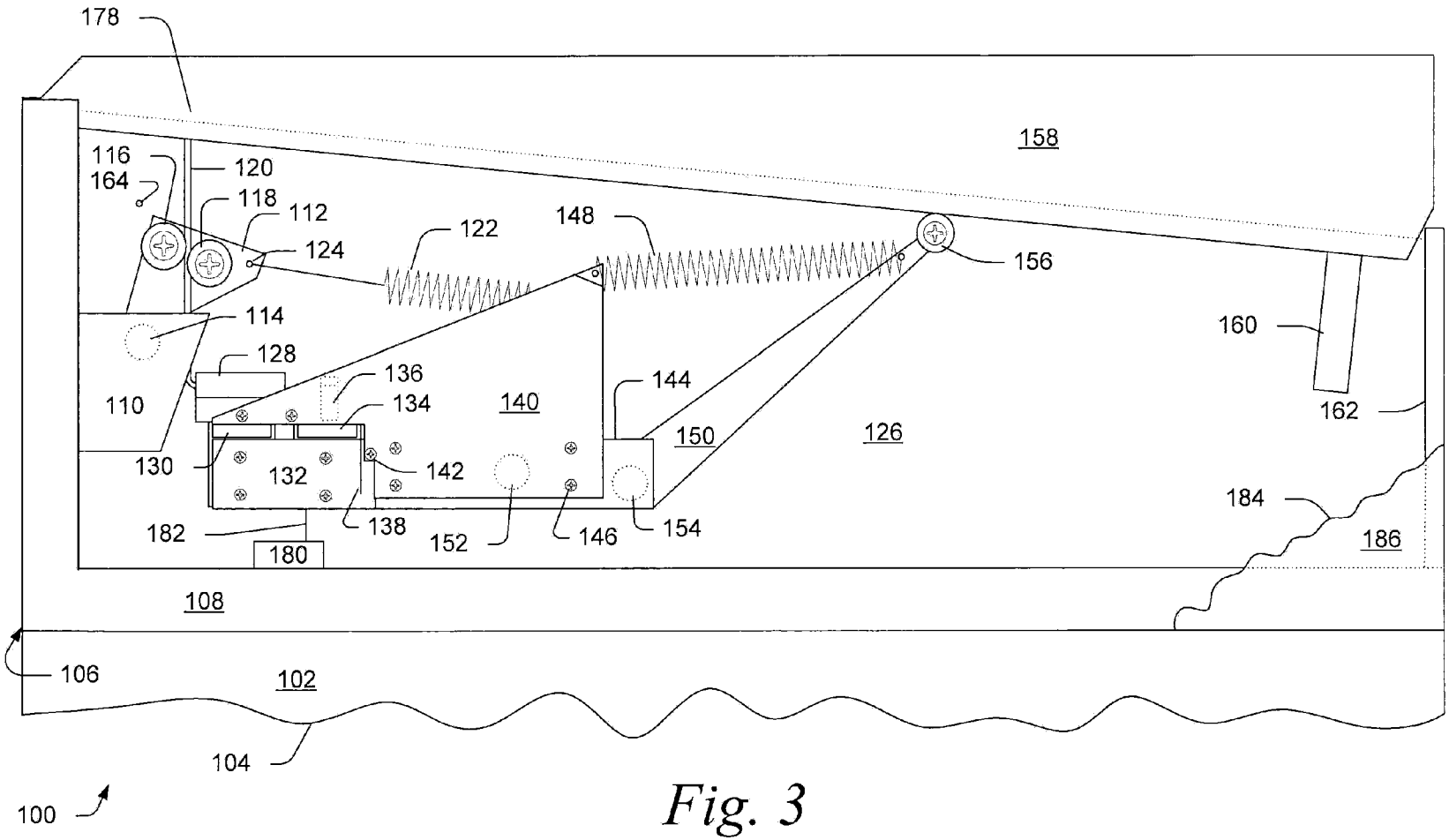
FIG. 3 is an illustration depicting the internal mechanism of one implementation of a collapsible door in the loaded position.

Referring to FIG. 3, an exemplary implementation illustrating a portion of a collapsible door 100 is depicted. The collapsible door 100 comprises a lower section 102. The lower section 102 is constructed using the same materials and in the same configuration as a typical door. A break line 104 indicates that the remainder of the lower section 102 has been omitted from the drawing.

The collapsible door 100 also comprises a suicide prevention kit 106. The suicide prevention kit 106 can be added to an existing door by removing the upper portion of an existing door and replacing the removed upper portion of an existing door with the suicide prevention kit 106. In one implementation, the kit replaces about 17 inches of the upper portion of an existing door. Alternately, the suicide prevention kit 106 can be integrated into a new door during construction of the new door.

The suicide prevention kit 106 is attached to the lower section 102 of the collapsible door 100 by a mounting bracket 108. A front panel 186 is mounted to the mounting bracket 108. The front panel 186 encloses the entire front of the suicide prevention kit 106. A break line 184 indicates that the remainder of the front panel 186 has been omitted from the drawing for clarity. A back panel 126 is attached to the mounting bracket 108. The back panel 126 encloses the entire back of the suicide prevention kit 106. The mounting bracket 108, back panel 126, and front panel 186 provide structural support for the different components of the suicide prevention kit 106. A pivot mounting bracket 110 is attached to the mounting bracket 108. A guide plate 112 is connected to the pivot mounting bracket 110 at pivot point 114. Two rod guides 116 and 118 hold a trigger rod 120 in place. A tension spring 122 is attached to guide plate 112 at an attachment point 124 and to the back panel 126 (attachment point not shown). The tension spring 122 applies tension to the guide plate 112 around pivot point 114 in order to apply a biased force against trigger rod 120 through rod guides 116 and 118.

The trigger rod 120 is connected to a drop segment 158 and to a trigger block 128. The trigger block 128 has an angled lower portion, which forms a wedge. The wedged portion of trigger block 128 rests against trigger roller 130. The trigger roller 130 is mounted on a plate 132 and fastened by two screws (shown but not numbered). A locking roller 134 is also attached to plate 132 by two screws (shown but not numbered). The locking roller rests against locking block 136. The locking block 136 is attached to the back panel 126. The top portion of locking block 136 is angled and the bottom portion of locking block 136 is squared. A slot 138 is cut into the plate 132. The portion of the plate 132 to the right of the slot 138 is bent so the portion to the right is parallel to the left portion of the plate 132, but closer to back panel 126. The lower portion of the plate 132 to the right of the slot 138 is in contact with a locking spring (not shown) that is compressed above the plate 132 and under a trigger bracket 140. The locking spring is attached to the trigger bracket 140 by screw 142. The locking spring under screw 142 applies pressure to the plate 132 towards the back panel 126. The locking spring functions to hold the locking roller 134 against the squared portion of locking block 136.

The trigger bracket 140 is attached to pivot block 144 by four screws 146 (only one screw is labeled). A loading block (not shown) is attached to the leftmost portion of trigger bracket 140 by two screws (shown but not labeled). The loading block is for loading the suicide prevention assembly after it has been triggered. A tension spring 148 is attached to trigger bracket 140 at one end and is attached to support arm 150 at the other end.

The pivot block 144 is attached on the left side to plate 132. The pivot block 144 is attached to the back panel 126 at a pivot point 152. The support arm 150 is attached to pivot block 144 at a pivot point 154. A roller 156 is attached to the opposite end of support arm 150.

The drop segment 158 is supported by roller 156 and by trigger rod 120. A stopper 160 may be attached to drop segment 158 to control the downward motion of drop segment 158. The stopper 160 comes in contact with mounting bracket 108 and the drop segment 158 comes into contact with a pin 164 once the suicide prevention kit 106 is activated. A segment 162 is attached to the back panel 126. The segment 162 covers the space along the edge of the suicide prevention kit 106.

Application of sufficient force on the top portion of drop segment 158 will activate the suicide prevention kit 106. Force applied downward on the top of drop segment 158 causes the drop segment to move downward. A small force will move the drop segment a small distance downward, causing the roller 156 to travel to the right along the bottom surface of drop segment 158. As the roller 156 travels to the right along the bottom edge of the drop segment 158, the support arm 150 pivots about pivot point 154, thereby stretching tension spring 148.

The pivot assembly comprises the trigger bracket 140, the pivot block 144, the plate 132, the trigger roller 130, the locking roller 134, the support arm 150, the tension spring 148, and the roller 156. As the downward force applied to the top of drop segment 158 increases, the force applied by tension spring 148 to the pivot assembly around pivot point 152 also increases. However, the locking block 136 prevents the pivot assembly from moving about pivot point 152.

As the drop segment 158 moves downward under a force, the trigger rod 120 and the trigger block 128 are also forced downward. As the downward force increases, the lower wedged portion of the trigger block 128 moves down and under the trigger roller 130. This movement forces the trigger roller 130 to ride up along the lower wedged portion of the trigger block 128 and rise away from the back panel 126. As the trigger roller 130 rises away from the back panel 126, the locking spring under screw 142 compresses and the plate 132 and the locking roller 134 rise away from the back panel 126. As the downward force continues to increase, the force will eventually reach a level that is sufficient to push the trigger block 128 down a sufficient amount that the locking roller 134 is raised far enough from the back panel 126 to clear the locking block 136. At this level of downward pressure, a significant amount of force has been stored in tension spring 148, which is applied to the pivot assembly in a clock wise direction around pivot point 152.

Once the locking roller 134 clears the locking block 136, the energy stored in the tension spring 148, as well as additional force being applied along the top of drop segment 158 and from the weight of drop segment 158, is released, resulting in the pivot assembly rotating clockwise around pivot point 152. As the pivot assembly rotates clockwise, the physical support at roller 156 for the drop segment 158 is removed, causing the drop segment 158 to drop downward into the suicide prevention kit 106 and toward the mounting bracket 108.

The tension spring 122 pulls the guide plate 112 around pivot point 114. As the drop segment 158 falls, the biased force exerted on trigger rod 120 by rod guides 116 and 118 cause the trigger rod 120 to tilt to the right as the drop segment 158 and the trigger rod 120 falls into suicide prevention kit 106. Once the drop segment 158 comes to rest after the suicide prevention kit 106 has been triggered, the drop segment 158 will form an angled top surface.

A sensor 180 may be attached to mounting bracket 108. A sensor rod 182 is attached to the sensor 180. The other end of the sensor rod 182 is in contact with plate 132. The sensor 180 detects when the suicide prevention kit 106 is activated and may be configured to communicate an alert, such as by flashing a light, transmitting a message via a wireless network (e.g., an IEEE 802.11 network, cellular network, or other wireless standard), or sounding an alarm.

Figure 4:
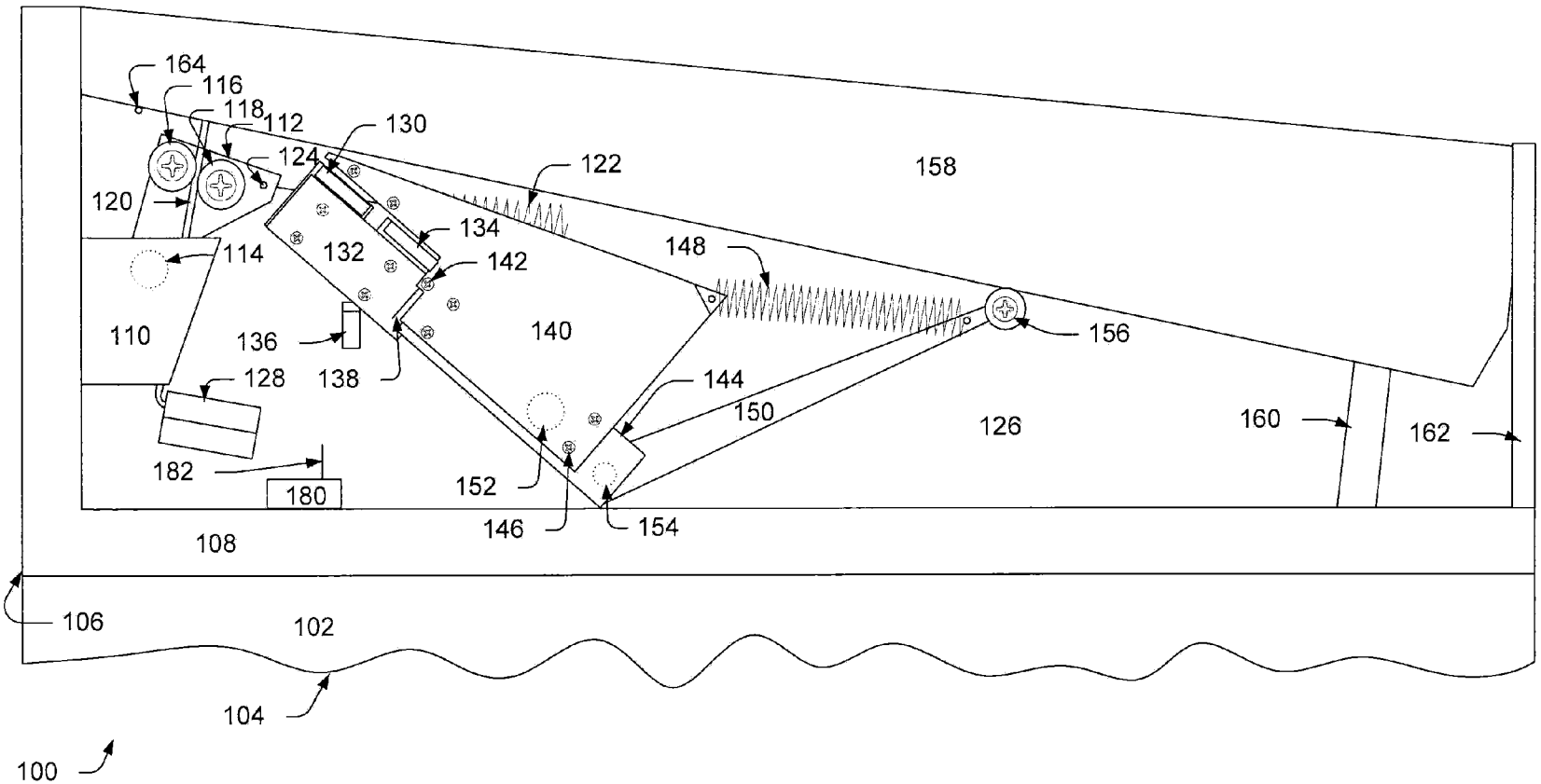
FIG. 4 is an illustration depicting the collapsible door of FIG. 3 in the triggered or collapsed position.

Referring to FIG. 4, the implementation of FIG. 1, after the suicide prevention kit 106 has been activated, is depicted. The downward pressure applied to the top surface of the drop segment 158 drives the trigger rod 120 and the trigger block 128 down toward the mounting bracket 108. As the trigger block moves down, the trigger roller 130 rides up along the lower wedged portion of the trigger block 128, raising the plate 132 away from the back panel 126 and compressing the locking spring under screw 142. Once the locking roller 134 rises a sufficient distance to clear locking block 136, the force provided by tension spring 148 causes the pivot assembly to rotate clockwise about pivot point 152.

The drop segment 158 falls into suicide prevention kit 106 once the two points of support, roller 156 and trigger rod 120, fall downward toward mounting bracket 108. The drop segment 158 falls until the stopper 160 comes in contact with the mounting bracket 108 and drop segment 158 comes in contact with pin 164. The top surface of drop segment 158 forms a sloped surface in which any load will slide down and off the right side of the suicide prevention kit 106.

As the pivot assembly rotates clockwise about pivot point 152, the plate 132 breaks contact with sensor rod 182. The sensor 180 then communicates an alert notification indicating that the suicide prevention kit 106 has been activated.

Figure 5:
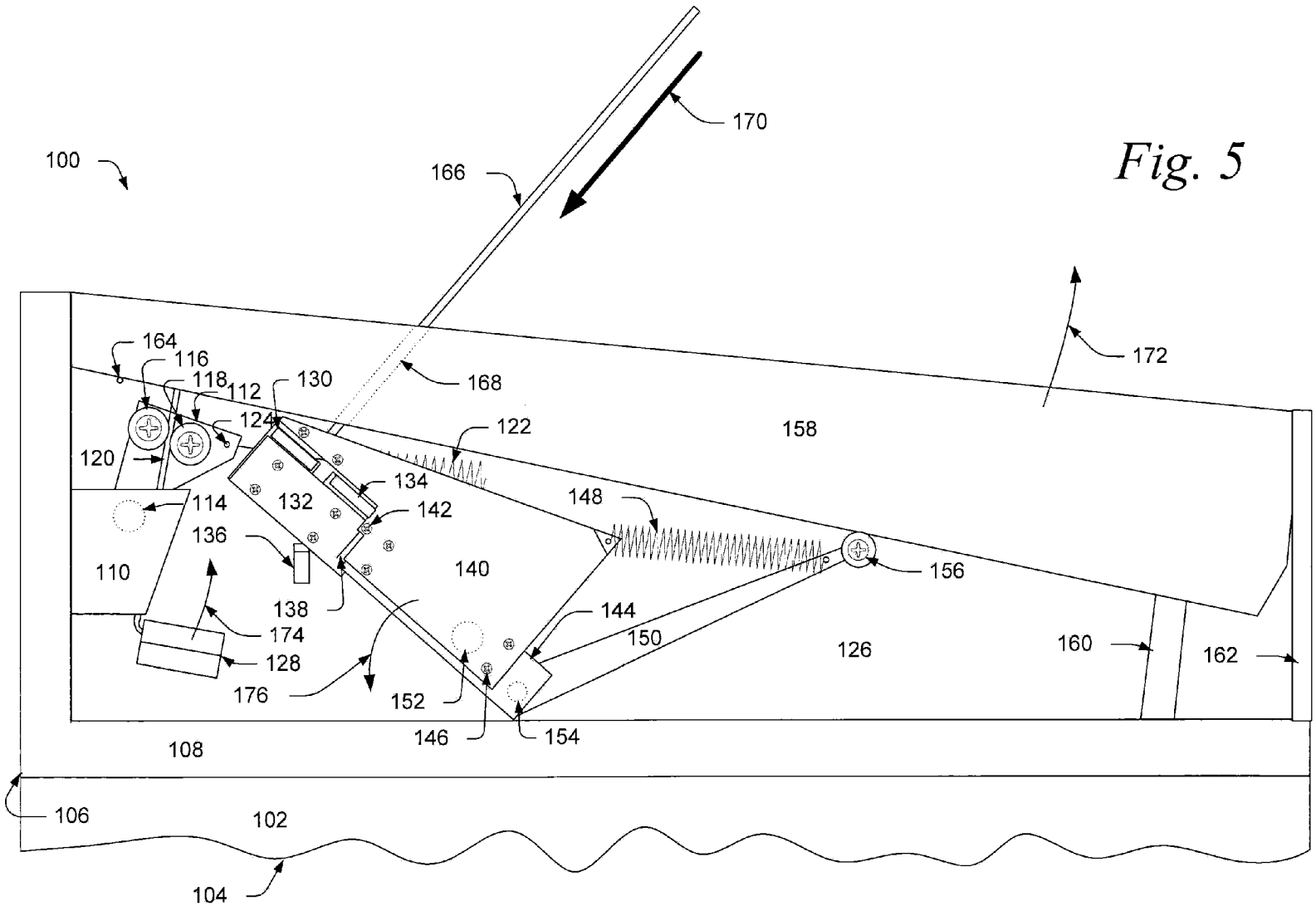
FIG. 5 is an illustration depicting the procedure for reloading the collapsible door of FIG. 4.

FIG. 5 depicts an exemplary method of resetting the suicide prevention kit 106 of FIG. 1 after the suicide prevention kit 106 has been activated. A reset rod 166 is inserted into reset channel 168 until the reset rod comes in contact with the loading block (not shown) attached to the trigger bracket 140. The loading block is attached to the leftmost portion of trigger bracket 140 by two screws (shown but not labeled). A force 170 is exerted on reset rod 166 that causes the pivot assembly to rotate counter-clockwise around pivot point 152 as shown by arrow 176.

As the pivot assembly rotates, a force is applied upward on drop segment 158 by roller 156, causing the drop segment 158 to rise upward away from the mounting bracket 108 as shown by arrow 172. The locking roller 134 will then contact the top wedged portion of locking block 136. As the pivot assembly continues to rotate, the locking block 134 will ride up the wedged portion of locking block 136, raise plate 132 up and away from the back panel 126, and compress the locking spring under screw 142. As the locking roller 134 travels past the bottom end of the locking block 136, the locking roller 134 falls against back panel 126 as a result of the force exerted by the compressed locking spring under screw 142.

As the drop segment 158 rises up and away from pin 164, trigger rod 120 and trigger block 128 rise as shown by arrow 174. The trigger block 128 passes under the trigger roller 130 at the point where the plate 132 is elevated off the back panel 126 as a result of locking roller 134 riding up on locking block 136. The trigger block 128 therefore travels under trigger roller 130 without being obstructed.

Once the locking roller 134 clears the locking block 136, the suicide prevention kit 106 is reset and the reset rod 166 is removed from reset channel 168. At this point, the suicide prevention assembly is ready for operation.

Figure 6:
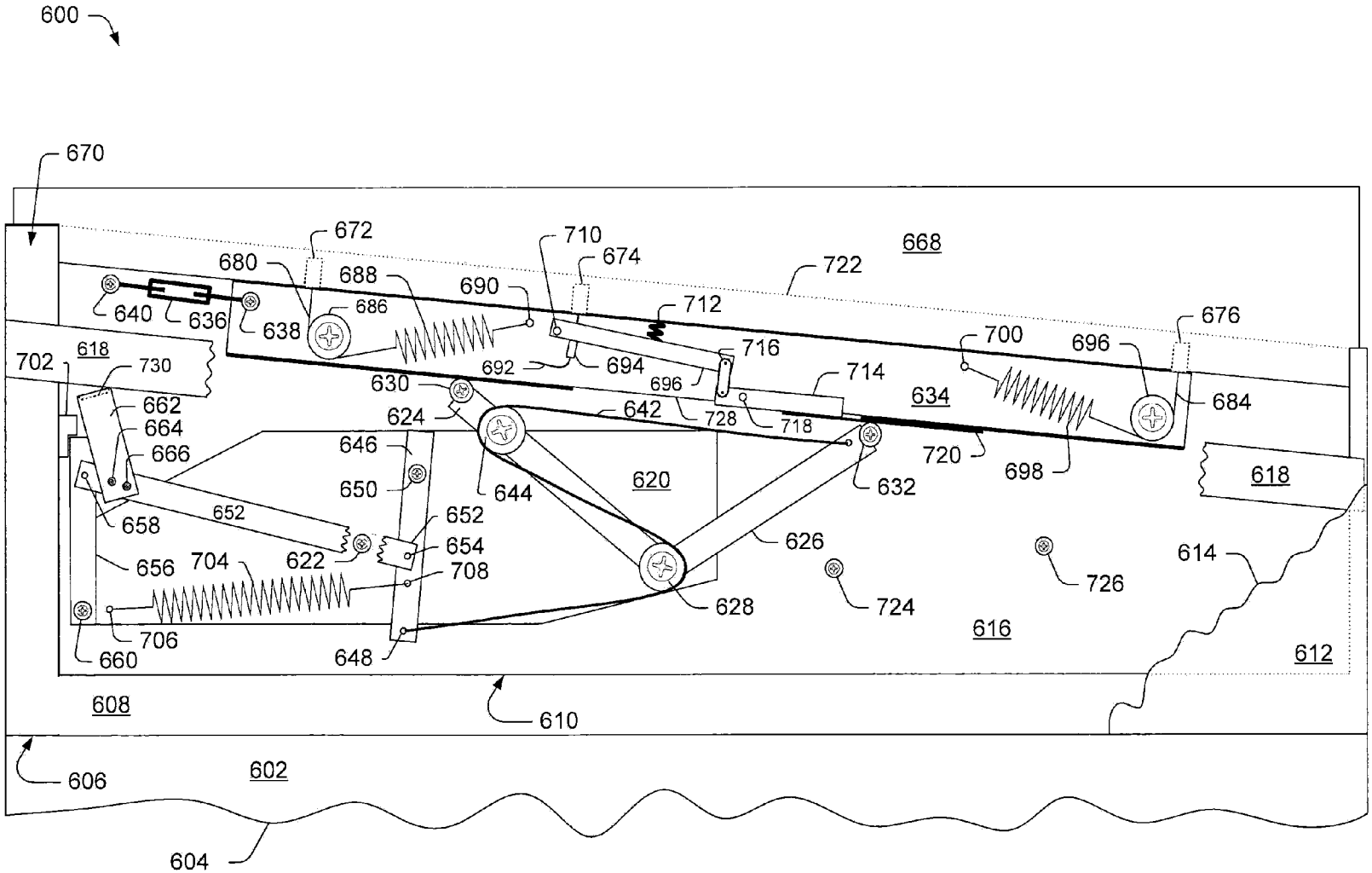
FIG. 6 is an illustration depicting the internal mechanism of another implementation of a collapsible door that is triggered by a downward force and/or a lateral force.

Referring to FIG. 6, an exemplary implementation illustrating a portion of a collapsible door 600 that is triggered by a downward or lateral force is depicted. The collapsible door 600 comprises a lower section 602. The lower section 602 is constructed using the same materials and in the same configuration as a typical door. A break line 604 indicates that the remainder of the lower section 602 has been omitted from the drawing.

The collapsible door 600 also comprises a collapsible module 606. The collapsible module 606 can be added to an existing door by removing the upper portion of the door and replacing the removed upper portion with the collapsible module 606. Alternately, the collapsible module 606 can be integrated into a new door during construction.

In one implementation, the collapsible module 606 is attached to the lower section 602 of the collapsible door 600 by a mounting bracket 608. The interior of the collapsible module 606 contains an enclosed cavity 610. A front panel 612 is mounted to the mounting bracket 608. The front panel 612 encloses the front portion of the collapsible module 606. A break line 614 indicates that the remainder of the front panel 612 has been omitted from the drawing for clarity. A back panel 616 is attached to the mounting bracket 608. The back panel 616 encloses the entire back of the collapsible module 606. A broken line 722 indicates the top edge of the back panel 616 and front panel 612. The mounting bracket 608, back panel 616, and front panel 612 provide structural support for the different components of the collapsible module 606.

A crossbar 618 is mounted to opposite sides of the mounting bracket 608 to provide structural support. The central portion of the crossbar 618 has been removed (as indicated by break lines) to reveal the interior mechanism of the collapsible module 606.

A pivot plate 620 is rotationally attached to the back panel 616 by screw 622. Support arm 624 and support arm 626 are rotationally attached to the pivot plate 620 under pulley 628. Each support arm 624 and 626 has a roller, 630 and 632 respectively.

A tension wire 642 is attached to support arm 626, runs over pulley 644 on support arm 624, over pulley 628, and is attached to a leverage arm 646 at attachment point 648.

A leverage arm 646 is pivotally attached to the pivot plate 620 at attachment point 650. A linking bar 652 is attached to the leverage arm 646 at attachment point 654. A portion of the linking bar 652 has been omitted (as indicated by break lines) to reveal the pivot point for the pivot assembly at screw 622. The opposite end of the linking bar 652 is attached to a latch bar 656 at attachment point 658. The latch bar 656 is pivotally attached to pivot plate 620 at attachment point 660. A loading bar 662 is attached to linking bar 652 at attachment points 664 and 666. A channel 730 is formed in the top of loading bar 652 and used for resetting the pivot plate 620 after the collapsible door 600 has been triggered.

A locking block 702 is attached to the mounting bracket 608. When the collapsible door 600 is in the loaded position, as shown in FIG. 6, the latch bar 656 is held in place by the horizontal portion of the locking block 702. In this loaded position, the pivot plate 620 is held in place as shown in FIG. 6, thereby supporting the blade rail 634 and blade 668 in the raised position. The latch bar 656 is held securely in the loaded position against the locking block 702 by tension spring 704. Tension spring 704 is attached to the pivot plate 620 at attachment point 706. The opposite end of tension spring 704 is attached to leverage arm 646 at attachment point 708. The tension spring 704 exerts a force on leverage arm 646 causing it to rotate clockwise about attachment point 650. This motion is transferred to the linking bar 652, which is in turn transferred to the locking bar 656, causing it to rotate counterclockwise about attachment point 660. Therefore, as a result of the force exerted by tension spring 704, the locking bar 656 is forced against the locking block 702.

A blade rail 634 is centrally supported by rollers 630 and 632. The blade rail is also supported on the left end by turn buckle screw 636 at attachment point 638. The opposite end of the turn buckle screw 636 is attached to the back panel 616 at attachment point 640 to provide a stationary attachment point for the blade rail, which also serves as a pivot point when the blade rail drops.

A collapsible door blade 668 is attached to the blade rail 634. The blade 668 is also attached to the mounting bracket 608 at attachment point 670 (not visible in FIG. 6). When the blade 668 drops, the blade 668 pivots at attachment point 670. The opposite end of the blade 668 is not attached to the mounting bracket 608, which allows that portion of the blade 668 to drop down into the collapsible module 606 when triggered.

In one implementation, the blade 668 is attached to the blade rail 634 at multiple anchor points 672, 674, 676. In one implementation, the anchor points 672, 674, and 676 are embedded within the blade 668. A wire 680 attaches to anchor point 672. The wire 680 runs over pulley 686, which is mounted to blade rail 634, and connects to tension spring 688. Tension spring 688 is attached to the blade rail 634 at attachment point 690.

A wire 692 attaches to anchor point 674. The wire 692 passes through pivot arm 696 and through a holder 694, which secures the wire 692.

The wire 684 attaches to anchor point 676. The wire 684 runs over pulley 696, which is mounted to blade rail 634, and connects to tension spring 698. Tension spring 698 is attached to the blade rail 634 at attachment point 700. The tension springs 688 and 698 hold the blade 668 in a vertical position, but also allows the top of the blade 668 to move laterally (i.e., tilt backwards and forwards relative to the view in FIG. 6) while the blade rail 634 remains stationary.

A leverage arm 696 is pivotally attached to the blade rail 634 at attachment point 710. A spring 712 pushes against leverage arm 696, which creates a clockwise rotational force about attachment point 710. The spring 712 ensures that the wire 692 is held taut. A trigger bar 714 is connected to the leverage arm 696 by linkage 716. The trigger bar 714 is pivotally attached to the blade rail 634 at attachment point 718. A trigger plate 720 is attached to trigger bar 714.

The blade rail is u-shaped along its length, with the top and bottom edge extending toward the viewer from the portion visible in FIG. 6. A portion of the bottom edge is removed at opening 728 to permit the trigger bar 714 to extend through the opening 728 and to permit the trigger plate 720 to rest on the underside of the blade rail 634. The trigger plate is not directly connected to the blade rail, but is held in place by trigger bar 714.

A stopper 724 is attached to the back plate 616 and positioned to support the support arm 626 when the collapsible door 600 has been triggered. A stopper 726 is attached to the back plate 616 and positioned to support the blade rail 634 when the collapsible door 600 has been triggered.

The collapsible door 600 can be triggered by a downward force exerted on the top of blade 668, by a lateral force exerted on the blade 668 that causes the blade 668 to pivot backward or forward relative to the view in FIG. 6, or by a combination of a downward or lateral force.

When subjected to a downward force, the blade 668 and the blade rail 634 travel a small distance down into the collapsible door 600.

A sufficient downward force exerted on the blade 668 will trigger the mechanism and cause the blade to drop down into the collapsible door 600. If the downward force is insufficient to trigger the mechanism, the force exerted by the tension spring 704 will cause the blade 668 to return to its original position. If the force is sufficient, the mechanism is triggered as described in the following paragraphs.

As the blade rail 634 travels downward, it pushes against rollers 630 and 632, which causes the rollers to travel in opposite directions along the blade rail 634.

As the rollers travel in opposite directions, the length of wire 642 between support arm 626 and support arm 624 increases. As a result, the length of the wire 642 between roller 628 and leverage arm 646 decreases. This motion acts counter to the tension spring 704 and rotates the leverage arm 646 counterclockwise at attachment point 650. The leverage arm 646 causes the latch bar 656 to rotate clockwise at attachment point 660 via linking bar 652.

Once the top of latch bar 656 clears the locking block 702, the pivot plate 620 rotates clockwise. As a result, the support of the blade rail 634 is removed and the blade 668 is permitted to fall into the collapsible door 600. Once triggered, the support arm 626 will come to rest against stopper 724 and the blade rail 634 will come to rest against stopper 726.

When subjected to a lateral force, the blade 668 pivots along the bottom edge of the blade 668 that is in contact with the blade rail 634. As the blade 668 pivots in this manner, the wire 692 is pulled up, exerting a force that counters the force of the spring 712 and causes the pivot arm 696 to rotate counterclockwise about attachment point 710.

A sufficient lateral force exerted on the blade 668 will trigger the mechanism and cause the blade to drop down into the collapsible door 600. If the lateral force is insufficient to trigger the mechanism, the force exerted by the tension springs 688 and 698 and by the spring 712 will cause the blade 668 to return to a vertical position. If the force is sufficient, the mechanism is triggered as described in the following paragraphs.

The movement of the pivot arm 696 pulls up on the trigger bar 714 via the linkage 716. This causes the trigger bar 714 to rotate clockwise about attachment point 718. As a result, the trigger plate 720, which is attached to the trigger bar 714, is forced downward against the roller 632.

As the roller 632 is forced downward, the length of wire 642 between support arm 626 and support arm 624 increases. As a result, the length of the wire 642 between roller 628 and leverage arm 646 decreases. This motion acts counter to the tension spring 704 and rotates the leverage arm 646 counterclockwise at attachment point 650. The leverage arm 646 causes the latch bar 656 to rotate clockwise at attachment point 660 via linking bar 652. Once the top of latch bar 656 clears the locking block 702, the pivot plate 620 rotates clockwise. As a result, the support of the blade rail 634 is removed and the blade 668 is permitted to fall into the collapsible door 600. Once triggered, the support arm 626 will come to rest against stopper 724 and the blade rail 634 will come to rest against stopper 726.

Figure 7:
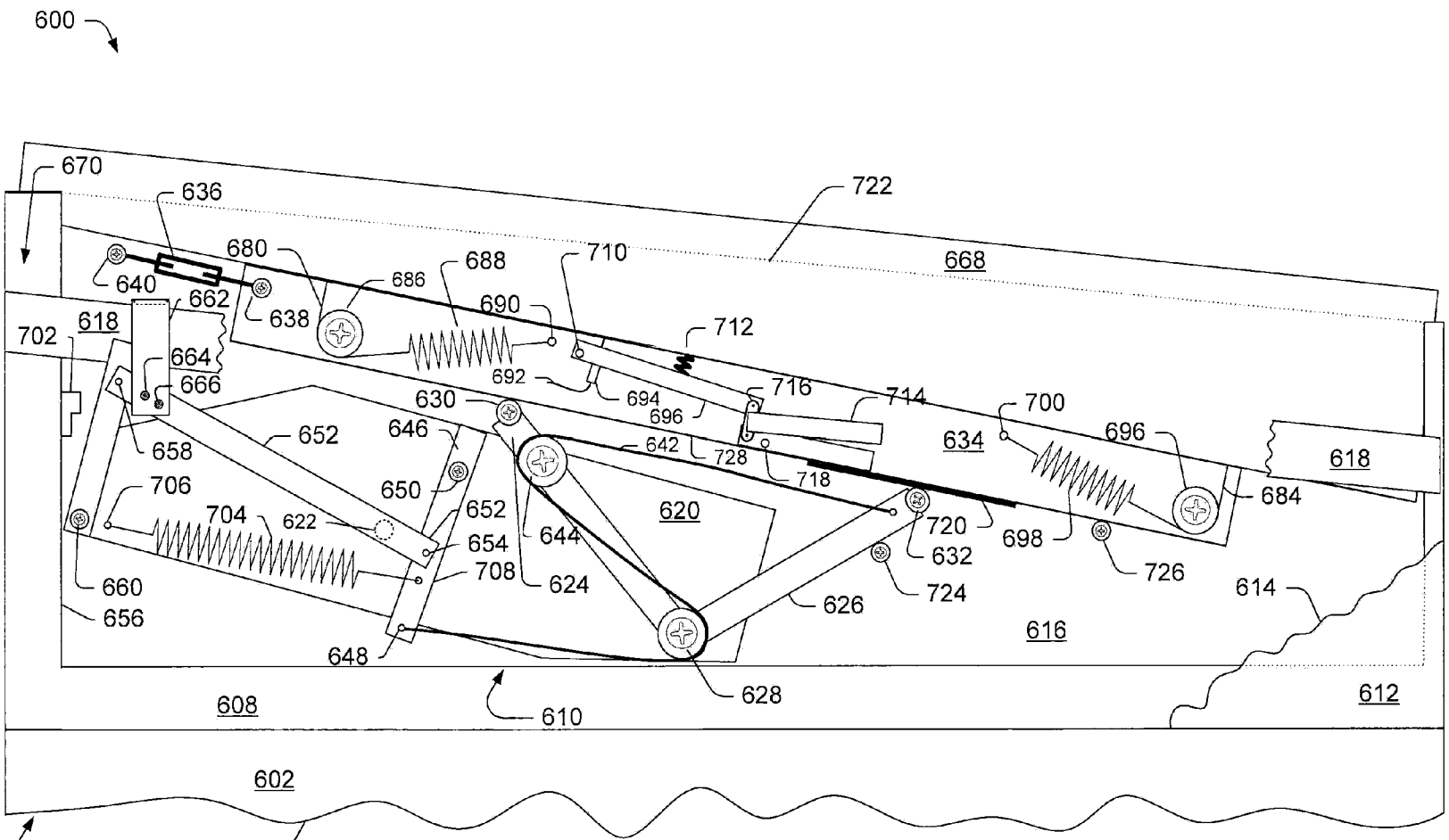
FIG. 7 is an illustration depicting the collapsible door of FIG. 6 in the triggered position.

Referring to FIG. 7, the collapsible door of FIG. 6 after being triggered is depicted. The top surface of the blade 668 is at an angle. The pivot plate 620 has been rotated about attachment point 622 (hidden by linking bar 652 in this view). The support arm 626 rests against stopper 724 and the blade rail 634 rests against stopper 726.

Figure 8:
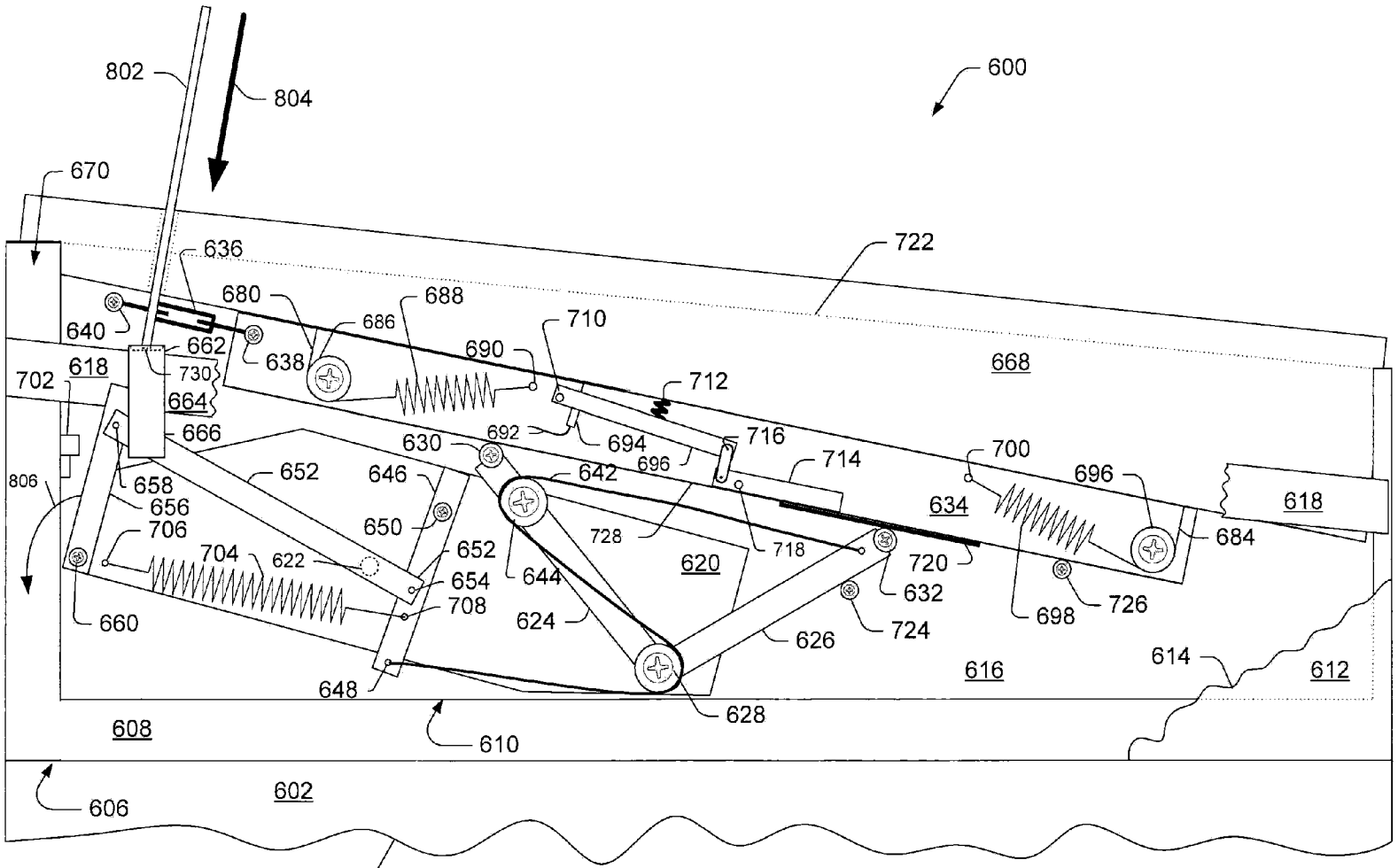
FIG. 8 is an illustration depicting the procedure for reloading the collapsible door of FIG. 7.

Referring to FIG. 8, the process for reloading the collapsible door of FIG. 7 is depicted. A reset rod 802 is inserted through an opening at the top of the collapsible door 600. In one implementation, the reset rod 802 is inserted into an opening formed in the top edge of the blade 668. In one implementation, the blade does not take up the entire space between the front panel 612 and back panel 616. In this implementation, a channel runs along most of the length of the blade 668 and the reset rod 802 is inserted into this channel.

The reset rod 802 is set into a channel in the top of the loading bar 662. A force 804 is exerted on reset rod 802 that causes the pivot plate 620 to rotate counter-clockwise around screw 622 as indicated by arrow 806. The pivot plate 620 rotates until the top of latch bar 656 travels past the lip of locking block 702 and locks in place.

As the pivot plate 620 rotates, the blade 668 and blade rail 634 are raised to a horizontal position by the support arms 624 and 626.

While the invention is described through the above-described exemplary implementations, it will be understood by those of ordinary skill in the art that modifications to, and variations of, the present system may be made without departing from the inventive concepts disclosed herein. For example, while the implementations are described in connection with various illustrative structures, one skilled in the art will recognize that the collapsible door may be embodied using a variety of dimensions, components, and mechanisms. Furthermore, disclosed aspects, or portions of these aspects, may be combined in ways not listed above. Accordingly, the invention should not be viewed as being limited to the disclosed implementations.

The present system may be embodied in other specific forms without departing from its spirit or essential characteristics. The described implementations are to be considered in all respects only as illustrative and not restrictive. The scope of the invention should, therefore, be determined not with reference to the above description, but instead should be determined with reference to the pending claims along with their full scope or equivalents, and all changes which come within the meaning and range of equivalency of the claims are to be embraced within their full scope.

What is claimed is:

1. A collapsible door, comprising:
a body formed to include a cavity;
a blade attached to the body, wherein the blade is configured to retract into the cavity; and
a mechanism disposed within the cavity;
the mechanism includes a pivot plate and is configured to transition the door between a loaded state and a triggered state;
the pivot plate configured in a first position in the loaded state to support the blade, wherein a top surface of the collapsible door is approximately horizontal in the loaded state; and
the pivot plate configured in a second position in the triggered state to cause the blade to retract into the cavity, wherein the top surface of the collapsible door is sloped in the triggered state to form an angle between about 6 degrees and about 45 degrees from the horizontal.

2. The collapsible door of claim 1, further including:
a handle attached to the body;
a latching mechanism integrated into the body; and
at least one hinge attached to the body for mounting the door to a doorframe.

3. The collapsible door of claim 1, wherein:
the top surface is formed by the blade in the horizontal position; and
the top surface is formed by the body in the sloped position.

4. The collapsible door of claim 1, wherein a pressure sensor is configured to detect a downward force exerted on the blade.

5. The collapsible door of claim 1, wherein the mechanism is configured to transition from the loaded state to the triggered state when a downward force exerted on the blade is greater than about 5 lbs.

6. The collapsible door of claim 1, wherein a pressure sensor is configured to detect a lateral force exerted on the blade.

7. The collapsible door of claim 1, wherein the mechanism is configured to transition from the loaded state to the triggered state when a lateral force exerted on the blade causes the blade to tilt about 5 degrees from the vertical.

8. The collapsible door of claim 1, wherein a pressure sensor is configured to detect a combination of a downward force exerted on the blade and a lateral force exerted on the blade.

9. The collapsible door of claim 1, wherein the mechanism includes a loading bar and the mechanism is configured to transition from the triggered state to the loaded state when a loading force is applied to the loading bar.

10. A collapsible door kit, comprising:
a body formed to include a cavity;
a mechanism disposed within the cavity, wherein:
the mechanism is configured to transition between a loaded state and a triggered state;
a top surface of the collapsible door kit is approximately horizontal in the loaded state; and
the top surface of the collapsible door kit is sloped in the triggered state;
a blade disposed at least partially above the mechanism, wherein the blade is supported by the mechanism; and
a pressure sensor in contact with the blade, wherein the pressure sensor is configured to cause the mechanism to transition from the loaded state to the triggered state, wherein the pressure sensor includes one of an electromechanical pressure sensor and a positional sensor.

11. The collapsible door kit of claim 10, wherein a support means supports the blade in the triggered position to form an angle between about 6 degrees and about 45 degrees from the vertical.

12. The collapsible door kit of claim 10, wherein the pressure sensor is configured to cause the mechanism to transition from the loaded state to the triggered state when the blade is subjected to a downward force exerted on the blade.

13. The collapsible door kit of claim 10, wherein the pressure sensor is configured to cause the mechanism to transition from the loaded state to the triggered state when the blade is subjected to a lateral force exerted on the blade.

14. The collapsible door kit of claim 10, further comprising:
a loading block attached to the mechanism, wherein the mechanism is configured to transition from the triggered state to the loaded state when a loading force is applied to the loading block.

15. A collapsible structure comprising:
a movable upper segment having a top surface;
a mechanism, wherein:
the movable upper segment is supported by the mechanism;
the mechanism is configured to transition from a loaded state to a triggered state when a lateral force is applied to the movable upper segment;
the top surface is between about 1 inch and about 3 inches wide and between about 20 inches and about 45 inches long;
the top surface is approximately horizontal in the loaded state; and
the top surface is sloped in the triggered state; and
a switch in communication with the mechanism, wherein the switch is configured to cause the mechanism to transition from the loaded state to the triggered state, wherein:

the switch is configured to activate when a supported load is disposed on the top surface; and the top surface is configured in the triggered state to allow the supported load to slide down and off the side of the collapsible structure.

16. The collapsible structure of claim 15, wherein the top surface forms an angle between about 6 degrees and about 40 degrees from the horizontal in the triggered state.

17. The collapsible structure of claim 15, wherein the switch is activated by a force exerted downward on the movable upper segment.

18. The collapsible structure of claim 17, wherein the force exerted downward on the movable upper segment is greater than about 5 lbs.

19. The collapsible structure of claim 15, wherein the switch is activated by the lateral force exerted on the movable upper segment.

* * * * *